United States Patent [19]

Itameri-Kinter et al.

[11] Patent Number: 4,984,973

[45] Date of Patent: Jan. 15, 1991

[54] HERMETIC MOTOR COMPRESSOR UNIT HAVING A HERMETIC TERMINAL WITH ELECTRICALLY INSULATING ANTI-TRACKING CAP

[75] Inventors: Terry Itameri-Kinter, North Attleboro; David W. Sauerbrey, Somerset, both of Mass.

[73] Assignee: Tecumseh Products Company, Tecumseh, Mich.

[21] Appl. No.: 497,085

[22] Filed: Mar. 21, 1990

[51] Int. Cl.[5] ..... F04B 35/04; H01R 13/533; H01B 17/30

[52] U.S. Cl. ..... 417/422; 174/152 GM; 174/211; 417/902; 439/519; 439/693; 439/926

[58] Field of Search ..... 174/152 GM, 211; 310/71; 417/422, 902; 439/519, 566, 685, 693, 926, 935

[56] References Cited

U.S. PATENT DOCUMENTS

| | | | |
|---|---|---|---|
| 2,138,660 | 11/1938 | Mann | 174/152 GM X |
| 2,458,748 | 1/1949 | Stupakoff | 174/152 GM |
| 3,605,076 | 9/1971 | Dozier | 174/153 R X |
| 3,721,948 | 3/1973 | Brandt et al. | 174/152 GM X |
| 4,252,394 | 2/1981 | Miller | 174/152 GM X |
| 4,292,464 | 9/1981 | Vogt et al. | 174/152 GM |
| 4,480,151 | 10/1984 | Dozier | 174/153 R |
| 4,584,433 | 4/1986 | Bowsky et al. | 174/152 GM |
| 4,609,774 | 9/1986 | LeMieux et al. | 174/152 GM |
| 4,700,999 | 10/1987 | Probst | 439/271 |

FOREIGN PATENT DOCUMENTS

| | | | |
|---|---|---|---|
| 1151037 | 7/1963 | Fed. Rep. of Germany GM | 174/152 |

*Primary Examiner*—Laramie E. Askin

*Attorney, Agent, or Firm*—Jeffers, Hoffman & Niewyk

[57] ABSTRACT

A hermetic terminal for carrying electric current into the housing of a hermetic compressor, including a cup-shaped metallic body member having a plurality of metallic conductor pins extending therethrough which are electrically insulated from the body member by hermetic glass seals. The body member includes a closed end having an inwardly facing contoured end surface, to which a correspondingly contoured contacting surface of an electrically insulating cap member is secured by means of a uniform layer of electrically insulating bonding material therebetween. The pins extend through passages in the cap member, whereby the cap member defines an oversurface distance between the pins and the body member. A portion of the oversurface distance is protected from contaminants which the compressor housing by means of an annular gap between the outer periphery of the cap member and the sidewall of the body member, and by respective annular gaps between the pins and corresponding passages in the cap member.

20 Claims, 3 Drawing Sheets

HERMETIC MOTOR COMPRESSOR UNIT HAVING A HERMETIC TERMINAL WITH ELECTRICALLY INSULATING ANTI-TRACKING CAP

BACKGROUND OF THE INVENTION

The present invention relates generally to hermetic compressors of the type having a hermetic housing, wherein a hermetic terminal is provided for carrying electric current into the housing and, more particularly, to such a terminal that provides an electrically insulating oversurface distance between the current-conducting pins and the metallic body member of the hermetic terminal.

Terminal assemblies for hermetic compressors are well-known in the art and generally comprise a cup-shaped metallic body member having a plurality of metallic conductor pins extending therethrough. The pins are generally glass-sealed to the insulator body to prevent leakage to or from the atmosphere.

A problem associated with prior art electrical terminals for hermetic compressors is that, during compressor operation, a process known as electrophoresis may occur, whereby metallic particles present within the system migrate toward and deposit upon the hermetic terminal conducting pins and the surface of the glass seal insulator. Also, other phenomena may result in the presence of carbonaceous contaminants within the housing. These particles and contaminants can accumulate to the extent that an electrically conductive path is formed between a pin and the metallic body member, i.e., a ground fault, or between respective pins, i.e., a short circuit, thereby resulting in terminal failure.

One method for preventing or minimizing the occurrence of the aforementioned failure mode of the hermetic terminal is to provide an electrically insulating cap around the terminal to increase the pin-to-ground oversurface distance. In U.S. Pat. No. 2,458,748, an electric terminal having a hermetic seal includes an insulating collar disposed over a glass seal between a terminal pin and a metal wall through which the pin extends, thereby providing an extended leakage path for current therebetween. Although such an insulating collar increases the oversurface distance between the terminal pin and the metal wall, the collar is still susceptible to having contaminants deposited thereon, thereby providing a leakage path.

It is desired to provide a hermetic terminal that is effective in minimizing terminal failure due to ground faults or short circuits caused by the build up of electrically conductive contaminants within the system.

SUMMARY OF THE INVENTION

The present invention provides a hermetic terminal for a hermetic compressor in which an electrically insulating cap member cooperates with a metallic terminal body and a plurality of current-conducting pins to provide pin-to-pin and pin-to-ground oversurface distances having restricted passages or protected spaces that inhibit the deposit of contaminant thereon.

Generally, the present invention provides a hermetic terminal having a metallic body member and a plurality of insulated current-conducting pins extending therethrough. An electrically insulating cap is secured to the metallic body and surrounds each of the current-conducting pins to provide an oversurface distance between respective pins and the metallic body. The insulating cap is specifically designed to inhibit the deposit of electrically conductive contaminants on protected portions of the oversurface distance during compressor operation.

Specifically, the invention provides a hermetic terminal including a cup-shaped metallic body member having a cylindrical sidewall closed at one end by an end wall through which a plurality of current-conducting pins extend. An electrically insulating cap is sealingly secured to the end wall and provides an oversurface distance between the conducting pins and the metallic body member. In one aspect of the invention, the insulating cap has a radially outer periphery that, together with the sidewall of the metallic body member, defines a gap to inhibit the deposit of contaminants on a protected portion of the oversurface distance. In a further aspect of the invention, the insulating cap is arranged to provide a ceiling portion along the oversurface distance, which is protected from the deposit of contaminants by facing a direction substantially opposite the open end of the metallic body member.

An advantage of the hermetic terminal of the present invention is that the possibility of terminal failures due to ground faults or short circuits attributable to contaminant film on the terminal is minimized by the provision of protected portions along the oversurface distance between respective pins and the grounded metallic body member of the terminal.

Another advantage of the hermetic terminal of the present invention is that an electrically insulating cap surrounds the conducting pins to extend the oversurface distance between each conducting pin to the body member, and between respective conducting pins.

A further advantage of the hermetic terminal of the present invention is that the electrically insulating cap, together with the metallic body member and conducting pins, defines restricted passages and protected spaces, whereby the deposit of electrically conductive contaminants needed to complete a leakage path for current from the conducting pins to on another and to the body member is inhibited.

Yet another advantage of the hermetic terminal of the present invention is that the electrically insulating cap is sealingly secured to the body member in a manner ensuring electrical insulation between the conducting pins and the terminal body along any path other than the oversurface distance.

The invention provides, in one form thereof, a hermetic terminal for a hermetic motor compressor unit having a housing with an opening therein. The hermetic terminal is mounted in the housing opening and is adapted for carrying electric current from the exterior of the housing to the interior thereof. The terminal includes a metallic cup-shaped body member having an open end facing the interior of the housing, a closed end with an inner surface facing the interior of the housing, and a generally cylindrical sidewall therebetween. The closed end has a plurality of openings in which a corresponding plurality of current-conducting pins are received and extend therethrough, respectively. The terminal further provides an electrically insulating cap member having a bottom surface, a radially outer periphery, and a plurality of apertures therein corresponding to the plurality of current-conducting pins. The bottom surface of the cap member is secured to the inner surface of the closed end, with each of the apertures surrounding a respective one of the pins. The cap member defines an oversurface distance between respective pins, as well as between the metallic body member and each of the pins. According to the invention, a portion of the oversurface distance is protected from contaminants within the housing. In one aspect of the invention a substantially uniform gap is defined by the outer periphery of the cap member and the sidewall of the body member, whereby the gap inhibits the deposit of contaminants on a protected portion of the oversurface distance between current-conducting pins and the terminal body.

In another aspect of the invention, the cap member includes through passages defined by respective inner passage walls, through which the current-conducting pins extend, respectively. Accordingly, a protected portion of the aforementioned oversurface distance is defined by an annular gap between each pin and the inner passage wall of the respective through passage, wherein the gap extends axially along the pin and has a closely spaced open end and an opposite closed end. In this arrangement, pin-to-pin oversurface distances are provided with a protected portion.

The invention provides, in one form thereof, a hermetic terminal in a hermetic compressor, including a metallic cup-shaped body member with an open end facing the interior of the compressor, a closed end having an inner surface facing the interior of the compressor, and a generally cylindrical sidewall therebetween. The closed end of the metallic body member includes a plurality of collar portions defining respective pin openings to provide communication through the closed end. A plurality of current-conducting pins are disposed in the pin openings and pass through the body member. Each of the pin openings is hermetically sealed by an electrically insulating seal material disposed intermediate each of the pins and a corresponding collar portion. The inner surfaces of the closed end of the metallic body member and the collar portions define an inwardly facing contoured surface. An electrically insulating cap member, having a contacting surface corresponding in shape to the shape of the inwardly facing contoured surface, is positioned relative to the body member such that the contacting surface is adjacent the contoured surface. The cap member includes a plurality of apertures therein corresponding to the plurality of current-conducting pins such that the pins extend through the corresponding apertures. A substantially uniform layer of electrically insulating bonding material is disposed intermediate the contacting surface of the cap member and the contoured surface to secure the cap member to the body member. In this arrangement, the bonding material both bonds the cap member to the body member and fills in any gaps between the substantially corresponding surfaces thereof.

DESCRIPTION OF THE PREFERRED EMBODIMENT

Figure 1:
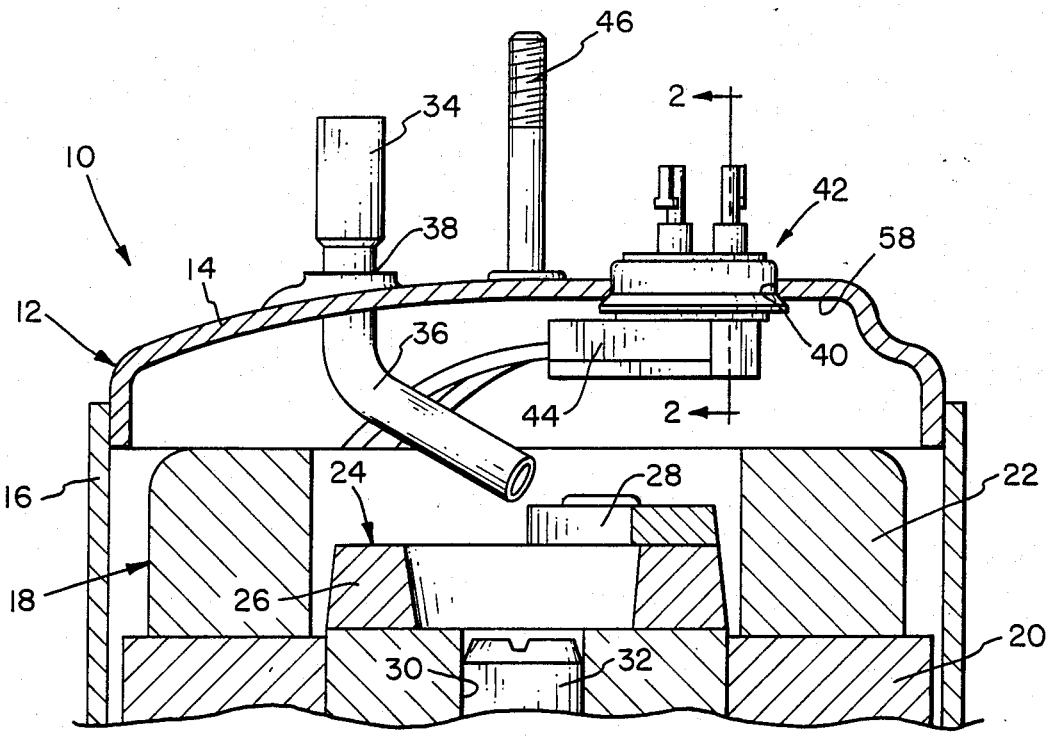
FIG. 1 is a fragmentary, partial sectional view of a hermetic compressor, including a hermetic terminal in accordance with the present invention.

In an exemplary embodiment of the invention as shown in the drawings, and in particular by referring to FIG. 1, a hermetic compressor 10 is shown having a housing generally designated at 12. Housing 12 comprises a top portion 14, a central portion 16, and a lower portion (not shown). The three housing portions are hermetically sealed together as by welding or brazing. Disposed within housing 12 is an electric motor generally designated at 18. Motor 18 comprises a stator 20 having windings 22, and a rotor 24 having an end cap 26 to which a counterweight 28 is attached. The stator is secured to housing 12 by an interference fit such as by shrink fitting.

Rotor 24 has a central aperture 30 provided therein into which is secured a rotatable crankshaft 32 by an interference fit. Crankshaft 32 is drivingly connected to a compressor mechanism (not shown), e.g., a reciprocating compressor or rotary vane compressor, which compresses refrigerant for discharge into the interior of housing 12. A refrigerant discharge tube 34 extends through top portion 14 of the housing and has an end 36 thereof extending into the interior of the compressor housing as shown. The tube is sealingly connected to housing 12 at 38, as by soldering.

Top portion 14 includes an opening 40 in which is provided a hermetic terminal assembly 42 in accordance with the present invention. Terminal assembly 42 carries electrical current from outside of housing 12 to motor 18 when compressor 10 is operably connected to an external power source (not shown). An electric plug and wiring assembly 44 connects to terminal assembly 42 on the interior of the housing and carries current to stator windings 22. Compressor 10 also includes a post 46 welded to top portion 14 for mounting a terminal cover (not shown) to cover terminal assembly 42 once compressor 10 is operably installed.

Figure 2:
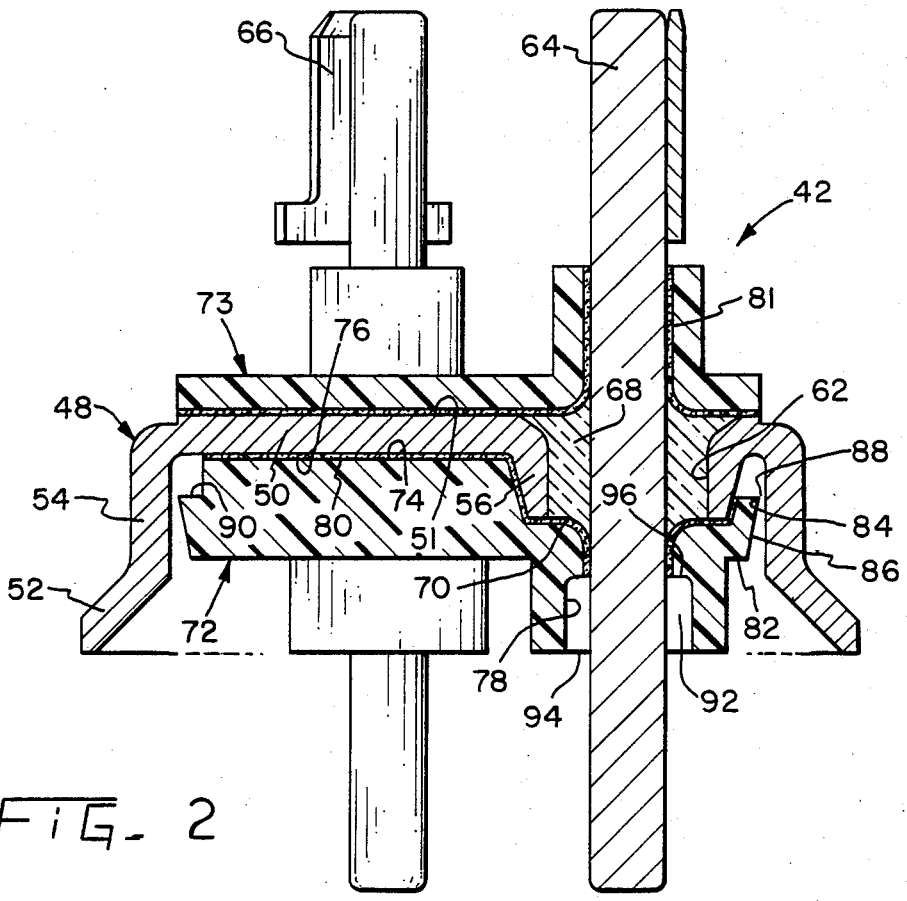
FIG. 2 is an enlarged longitudinal sectional view of the hermetic terminal of FIG. 1, taken along line 2—2 in FIG. 1.

Referring now to FIG. 2, terminal assembly 42 comprises a metallic, cup-shaped body member 48 having a closed end portion 50, a frustoconical flange 52, a cylindrical sidewall 54, and three inwardly extending collars 56 defining respective openings extending through body member 48. Flange 52 is disposed against an inner surface 58 of housing 48 when terminal assembly 42 is welded into place, thereby ensuring that the body member 48 will not be dislodged by high pressure within housing 12.

Each of collars 52 includes a cylindrical inner wall 62 defining an axial passage through which extends a metallic conductor pin 64. The conductor pins are preferably composed of 446 stainless steel or other suitable conducting materials, such as copper-core 446 stainless steel. Pins 64 are provided with tabs 66 secured to their external ends in order to facilitate the attachment of connecting leads (not shown). Conductor pins 64 are sealed to and insulated from body member 48 by glass seals 68, which are compression fused generally within respective collars 56 to provide glass-to-metal seals between pins 64 and collars 56. Each glass seal 68 includes an inwardly facing exposed surface 70.

In accordance with the present invention, hermetic terminal 42 includes an electrically insulating inner cap member 72 having a contacting surface 74 that generally corresponds in shape to a contoured surface 76 defined by closed end portion 50 and collars 56 of body member 48 and exposed surface 70 of glass seals 68. Additionally, cap member 72 includes apertures through which pins 64 extend wherein the apertures are axially extending through passages defined by inner passage walls 78. As shown in FIG. 2, cap member 72 is secured to body member 48 by a generally uniform layer of an electrically insulating adhesive 80 between contoured surface 76 and contacting surface 74. In addition to its function as a bonding agent, adhesive 80 fills any gaps between contoured surface 76 and contacting surface 74.

Cap member 72, as shown in FIG. 2, is generally disc-shaped and further includes a top surface 82 and a radially outer peripheral edge 84. When secured to body member 48, as previously described, cap member 72 defines an oversurface distance between body member 48 and each of the current-conducting pins 64. The expression "oversurface distance", as referred to herein, is intended to describe the surface of the body member over which a current path may be established between respective pins, or between a pin and the metallic body member, in the event a sufficient film of contaminant develops thereon. A primary object of the present invention is to protect a portion of the oversurface distance from contaminants within the housing, thereby reducing the possibility of an unwanted current path developing between respective pins, i.e., a short circuit, or between a pin and the metallic body member, i.e., a ground fault.

Referring once again to FIG. 2, a frustoconical transition portion 86 is formed between peripheral edge 84 and top surface 82 of cap member 72. An annular gap 88 is defined between the closely spaced peripheral edge 84 and sidewall 54 of body member 48. In the preferred embodiment, a substantially uniform radial distance of approximately 0.010–0.020 inch is maintained between peripheral edge 84 and sidewall 54 to define annular gap 88, i.e., the difference between the maximum diameter of cap member 72 and the inside diameter of sidewall 54 is approximately 0.020–0.040 inch.

Generally, gap 88 inhibits the deposit of contaminants on a protected portion of the oversurface distance by shielding the protected portion from direct exposure to the environment within compressor housing 12. Essentially, the portion of the oversurface distance axially inwardly of gap 88 is protected. More specifically, cap member 72 includes an annular ceiling surface 90 that faces substantially opposite the open end of metallic body member 48, as illustrated in FIGS. 2 and 3, thereby protecting it from any spray of contaminants.

In accordance with a further aspect of the embodiment of FIG. 2, cap member 72 provides additional oversurface distance near each pin 64. Specifically, the through passages defined by passage walls 78 are spaced circumjacent pins 64 to define an annular gap 92 extending axially along pin 64. Gap 92 has an open gap end 94 and a closed gap end 96. In the embodiment of FIG. 2, pin 64 and passage wall 78 are uniformly spaced a radial distance of approximately 0.030–0.040 inch along the axial length of gap 92, thereby inhibiting the deposit of contaminants on passage wall 78 so as to protect a portion of the oversurface distance.

Figure 3:
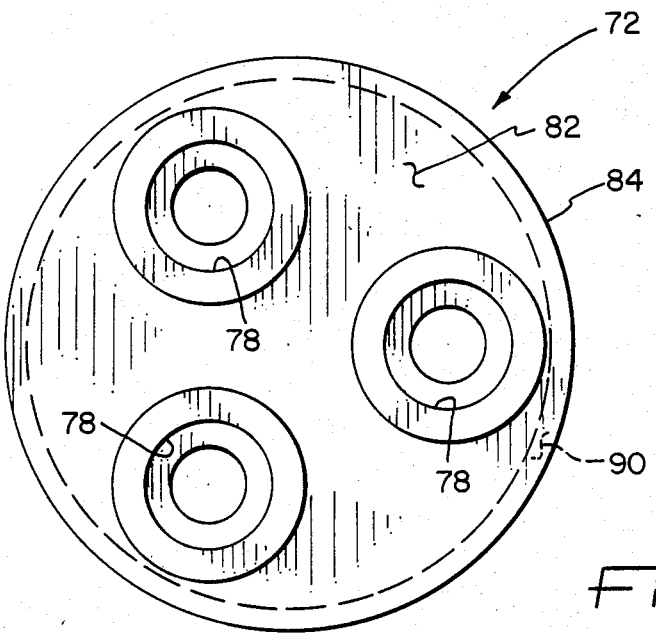
FIG. 3 is a top plan view of the cap member of the hermetic terminal of FIG. 2.
Figure 4:
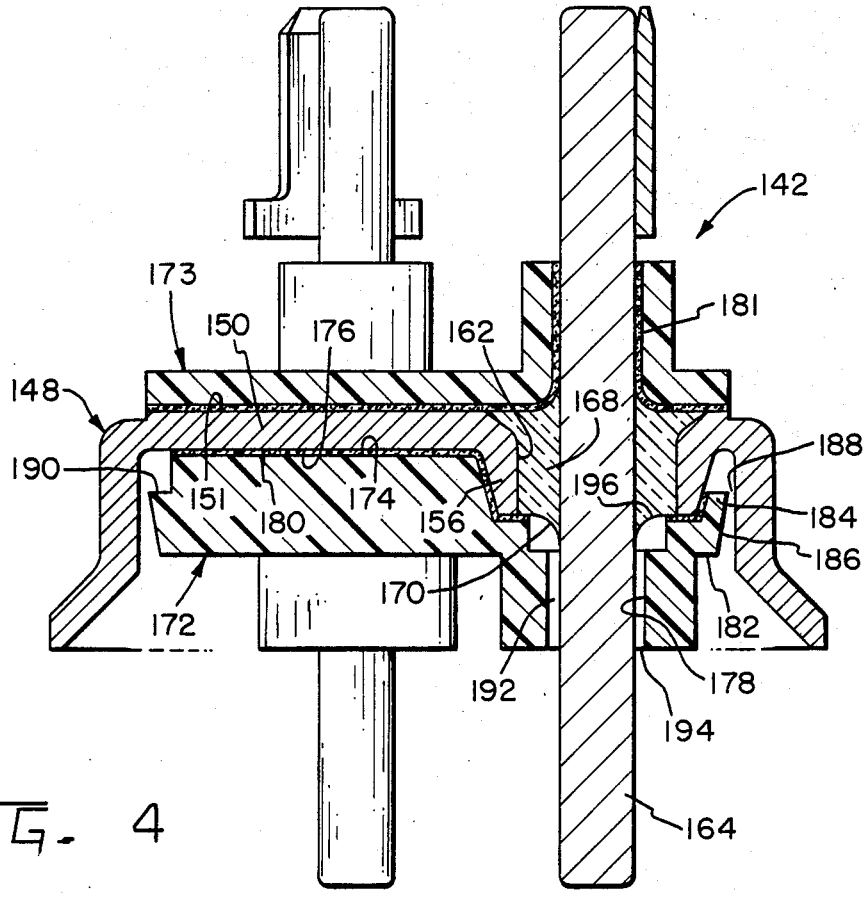
FIG. 4 is an enlarged longitudinal sectional view of a hermetic terminal applicable to the compressor of FIG. 1, in accordance with an alternative embodiment of the present invention, wherein the reference numerals are each 100 greater than those used to describe the embodiment of FIG. 2.
Figure 5:
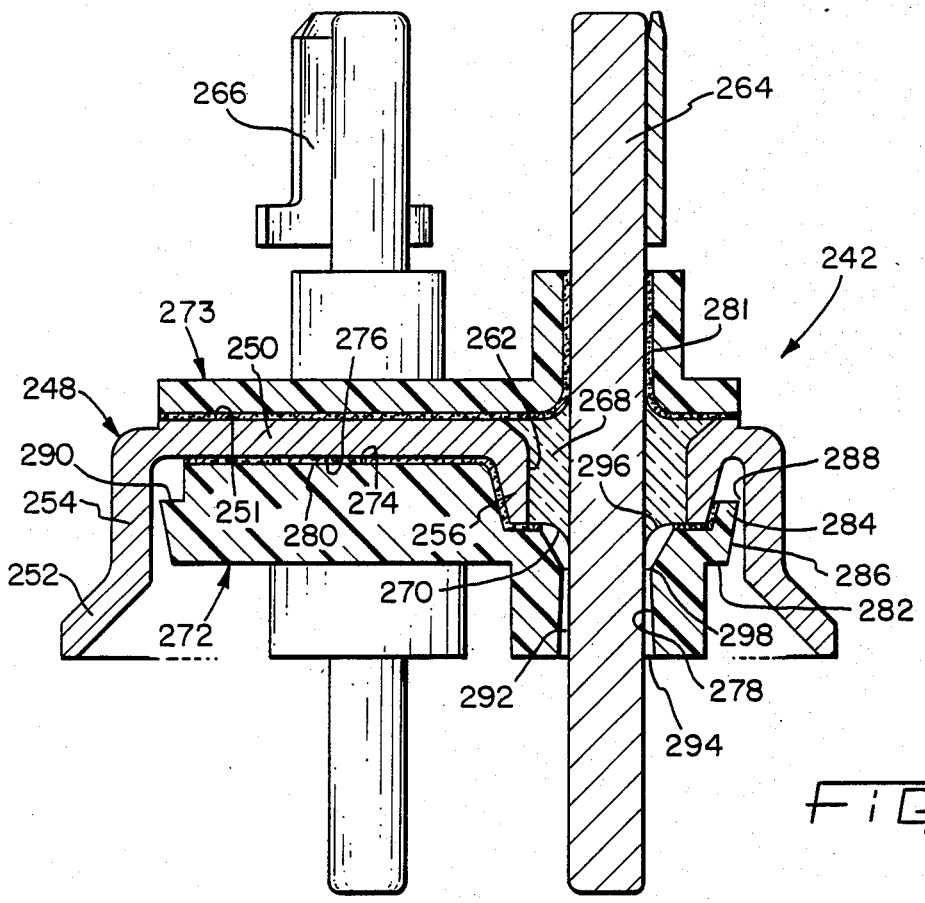
FIG. 5 is a enlarged longitudinal sectional view of another hermetic terminal applicable to the compressor of FIG. 1, in accordance with a another embodiment of the present invention, wherein the reference numerals are each 200 greater than those used to describe the embodiment of FIG. 2.
Figure 6:
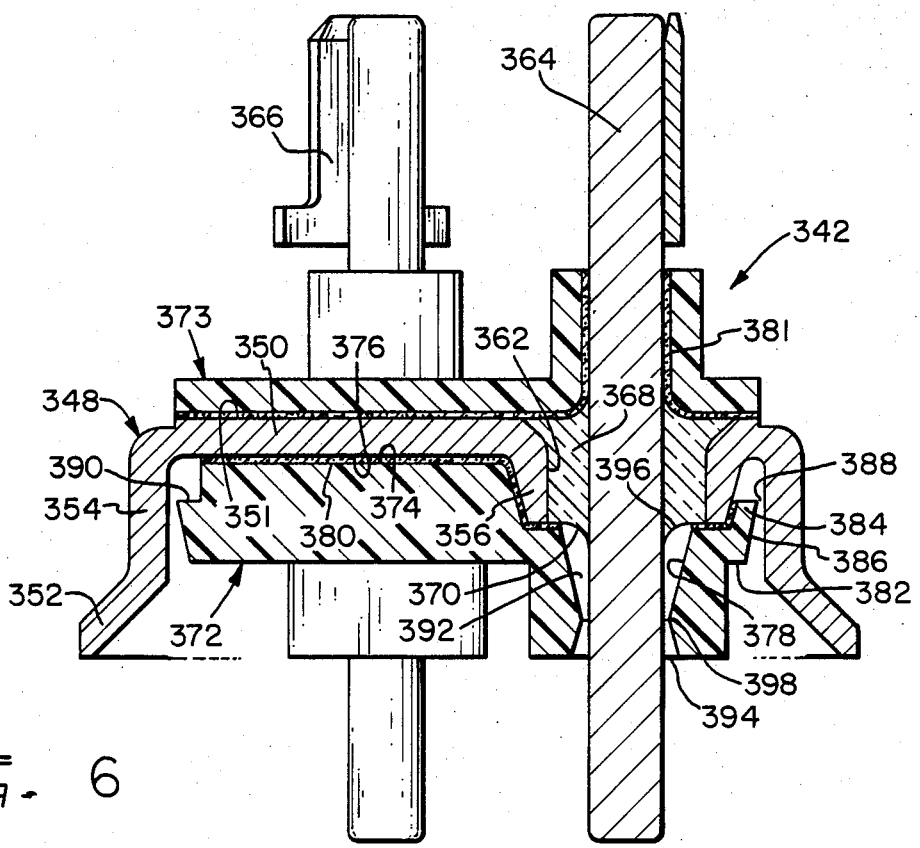
FIG. 6 is an enlarged longitudinal sectional view of a further hermetic terminal applicable to the compressor of FIG. 1, in accordance with a further embodiment of the present invention, wherein the reference numerals are each 300 greater than those used to describe the embodiment of FIG. 2.

FIGS. 4–6 show hermetic terminals applicable to the compressor of FIG. 1 in accordance with alternative embodiments of the present invention, wherein the aforementioned description of the embodiment of FIGS. 2 and 3 is equally applicable with the following exceptions. In each of the embodiments of FIGS. 4–6, cap member 72 is modified with respect to the apertures or through passages therein, i.e., the configuration of passage wall 78 is different in each embodiment to yield gaps 92 of varied diameters and shapes.

In the embodiment of FIG. 4, the diameter of passage wall 178 changes in stepped fashion from a smaller diameter adjacent open gap end 194 to a larger diameter adjacent closed gap end 196. In the embodiment of FIG. 2, contoured surface 76 includes all of exposed surface 70 of glass seal 68, and cap member 72 completely covers exposed surface 70 and is bonded to a portion of pin 64 adjacent thereto. In contrast, contoured surface 176 in the embodiment of FIG. 4 includes only a portion of exposed surface 170, and cap member 172 only partially covers exposed surface 170 and does not bond with pins 164. Accordingly, exposed surface 170 forms a part of the oversurface distance in the embodiment of FIG. 4.

In the embodiments of FIGS. 5 and 6 the diameter of passage wall 278, 378 decreases moving axially along annular gap 292, 392 from open gap end 294, 394 and closed gap end 296, 396 toward an axially intermediate location 298, 398, whereat the diameter of annular gap 292, 392 is a minimum. The slightly tapered closed gap end 296, 396 facilitates guided insertion of cap member 272, 372 onto pins 264, 364. As in the embodiment of FIG. 4, the embodiments of FIGS. 5 and 6 provide for contoured surface 276, 376 to include only a portion of exposed surface 270, 370. Therefore, cap member 272, 372 only partially covers exposed surface 270, 370 and does not bond with pins 264, 364.

In each of the aforementioned hermetic terminals, with particular reference to the embodiment of FIG. 2, an outer cap member 73 is secured to outer surface 51 of closed end 50, glass seals 68, and pins 64 by means of a generally uniform layer of an electrically insulating adhesive 81. In the preferred embodiment, adhesive 81 is the same as previously described adhesive 80, and outer cap member 73 is of the same material as inner cap member 72. In this arrangement, the mechanical bonding of cap member 73 to both body member 48 and pins 64 helps protect glass seals 68. Furthermore, outer cap member 73 extends the electrically insulating oversurface distance between pins 64 and body member 48.

In the preferred embodiment of the invention, adhesives 80 and 81 are #74011 Epoxy Insulating Varnish, manufactured by Insulating Materials, Inc. of Schenectady, N.Y. Likewise, inner cap member 72 and outer cap member 73 of the preferred embodiment are made of a plastic molding compound formulated for excellent arcing and tracking ratings, e.g., Mineral and Glass Reinforced Polyester Molding Compound #01581, commercially available from Plastics Engineering Company of Sheboygan, Wis. It is appreciated that other adhesives and molding compounds may be used that provide similar bonding, insulating, and anti-tracking properties, without departing from the spirit or scope of the invention.

It will be appreciated that the foregoing is presented by way of illustration only, and not by way of any limitation, and that various alternatives and modifications may be made to the illustrated embodiment without departing from the spirit and scope of the invention.

What is claimed is:

1. In a hermetic motor compressor unit having a housing with an opening therein, a hermetic terminal mounted in the housing opening and adapted for carrying electric current from the exterior of the housing to the interior thereof, comprising:

a metallic cup-shaped body member including an open end facing the interior of the housing, a closed end having an inner surface facing the interior of the housing, and a generally cylindrical sidewall therebetween, said closed end having a plurality of openings providing communication therethrough;

a plurality of current-conducting pins corresponding to said plurality of openings in said body member, each pin being received within and extending through a respective opening;

an electrically insulating cap member having a bottom surface, a radially outer peripheral edge, and a plurality of apertures therein corresponding to said plurality of current-conducting pins, said bottom surface of said cap member being secured to said inner surface of said closed end with each of said apertures surrounding a respective one of said pins, said cap member defining an oversurface distance between said metallic body member and each of said current-conducting pins; and means for protecting a portion of said oversurface distance from contaminants within said housing, said means including a substantially uniform gap defined by said outer peripheral edge of said cap member and said sidewall of said body member, whereby said gap inhibits the deposit of contaminants on said protected portion of said oversurface distance.

2. The hermetic motor compressor unit of claim 1 wherein said substantially uniform gap defined by said outer peripheral edge of said cap member and said sidewall of said body member is defined by a radial spacing therebetween in the range of 0.010–0.020 inch.

3. The hermetic motor compressor unit of claim 1 wherein said protected portion of said oversurface distance comprises an annular ceiling surface facing substantially oppositely said open end of said metallic body member.

4. The hermetic motor compressor unit of claim 1 wherein said cap member further comprises a top surface and a frustoconical transition portion between said top surface and said outer peripheral edge.

5. The hermetic motor compressor unit of claim 1 wherein each of said apertures of said cap member is spaced circumjacent a corresponding said pin in order to provide an additional protected portion of said oversurface, distance.

6. The hermetic motor compressor unit of claim 1, wherein said gap between said cap member and said sidewall is defined at a point of maximum diameter of said cap member.

7. The hermetic motor compressor unit of claim 6 wherein the dimensional difference between said maximum diameter of said cap member and the diameter of said sidewall of said body member is in the range 0.020–0.040 inch.

8. The hermetic motor compressor unit of claim 1 wherein said gap between said cap member and said sidewall constitutes a first gap, and each of said plurality of apertures in said cap member comprises a through passage defined by a respective inner passage wall, each said pin and corresponding said inner passage wall defining a second annular gap extending axially along said pin to further inhibit the deposit of contaminants on said oversurface distance.

9. The hermetic motor compressor unit of claim 8 wherein each said second annular gap has an open gap end and a closed gap end, and each said inner passage wall and corresponding said pin are closely spaced from one another at an axial location toward said open gap end.

10. The hermetic motor compressor unit of claim 1 wherein said inner surface and said openings of said body member define an inwardly facing contoured surface, and said bottom surface of said insulating cap member defines a contacting surface corresponding substantially in shape to said inwardly facing contoured surface, said cap member being positioned relative to said body member, said contacting surface being sealingly bonded to said contoured surface, and said pins extending through corresponding said apertures.

11. In a hermetic motor compressor unit having a housing with an opening therein, a hermetic terminal mounted in the housing opening and adapted for carrying electric current from the exterior of the housing to the interior thereof, comprising:

a metallic cup-shaped body member including an open end facing the interior of the housing, a closed end having an inner surface facing the interior of the housing, and a generally cylindrical sidewall therebetween, said closed end having a plurality of openings providing communication therethrough;

a plurality of current-conducting pins corresponding to said plurality of openings in said body member, each pin being received within and extending through a respective opening;

an electrically insulating cap member including a bottom surface and a plurality of through passages corresponding to said plurality of current-conducting pins, each of said through passages being defined by a respective inner passage wall, said bottom surface of said cap member being secured to said inner surface of said closed end with each one of said pins extending through a respective one of said through passages, said cap member defining an oversurface distance between said metallic body member and each of said current-conducting pins; and means for protecting a portion of said oversurface distance from contaminants within said housing, said means including an annular gap defined between each said pin and said inner passage wall of a corresponding said through passage, said annular gap extending axially along said pin and having an open gap end and a closed gap end, and said inner passage wall and corresponding said pin being closely spaced from one another at an axial location toward said open gap end, whereby said annular gap inhibits the deposit of contaminants on said protected portion of said oversurface distance.

12. The hermetic motor compressor unit of claim 11 wherein the diameter of said annular gap at said open gap end is less than the diameter of said annular gap at said closed gap end.

13. The hermetic motor compressor unit of claim 12 wherein said closed gap end comprises a frustoconical transition portion, whereby said transition portion facilitates guided insertion of said insulating cap onto said plurality of current-conducting pins during assembly of said hermetic terminal.

14. The hermetic motor compressor unit of claim 11 wherein a narrowed portion of said inner passage wall of each said through passage is contactingly circumjacent adjacent said corresponding pin at said closed gap end of said corresponding annular gap.

15. The hermetic motor compressor unit of claim 11 wherein said annular gap between each said pin and a corresponding said inner passage wall constitutes a first annular gap, and said cap member further comprises a radially outer periphery, said outer periphery and said sidewall of said body member defining a second annular gap to further inhibit the deposit of contaminants on another protected portion of said oversurface distance.

16. The hermetic motor compressor unit of claim 11 wherein said inner surface and said openings of said body member define an inwardly facing contoured surface, and said bottom surface of said insulating cap member defines a contacting surface corresponding substantially in shape to said inwardly facing contoured surface, said cap member being positioned relative to said body member, and said contacting surface being sealingly bonded to said contoured surface.

17. In a hermetic motor compressor unit having a housing with an opening therein, a hermetic terminal mounted in the housing opening and adapted for carrying electric current from the exterior of the housing to the interior thereof, comprising:

a metallic cup-shaped body member including an open end facing the interior of the housing, a closed end having an inner surface facing the interior of the housing, and a generally cylindrical sidewall therebetween, said closed end including a plurality of collar portions defining respective pin openings providing communication through said closed end;

a plurality of current-conducting pins corresponding to said plurality of openings in said body member, each pin being received within and extending through a respective opening;

means hermetically sealing each of said pin openings with a corresponding pin received therein, said means including an electrically insulating seal material disposed intermediate each of said pins and a corresponding said collar portion, said inner surface and said collar portions defining an inwardly facing contoured surface;

an electrically insulating cap member having a contacting surface corresponding substantially in shape to said inwardly facing contoured surface, said cap member including a plurality of apertures therein corresponding to said plurality of current-conducting pins, said cap member being positioned relative to said body member such that said contacting surface is adjacent said contoured surface and said pins extend through corresponding said apertures; and electrically insulating bonding means, intermediate said contacting surface of said cap member and said contoured surface, securing said cap member to said body member, said bonding means comprising a substantially uniform layer of electrically insulating bonding material, said substantially uniform layer of bonding material both bonding the cap member to the body member and filling in any irregular spaces between the substantially corresponding contours thereof.

18. The hermetic motor compressor unit of claim 17 wherein said inwardly facing contoured surface is further defined by said insulating seal material and an adjacent exposed portion of said pins.

19. The hermetic motor compressor unit of claim 17, wherein said cap member includes a radially outer periphery and defines an oversurface distance between said metallic body member and each of said conducting pins, and further comprising:

means for protecting a portion of said oversurface distance from contaminants within said housing, said means including a substantially uniform gap defined by said outer periphery of said cap member and said sidewall of said body member, whereby said gap inhibits the deposit of contaminants on said protected portion of said oversurface distance.

20. The hermetic motor compressor unit of claim 17 wherein said cap member comprises a plurality of through passages corresponding to said plurality of apertures, each of said through passages being defined by a respective inner passage wall, said cap member defining an oversurface distance between said metallic body member and each of said conducting pins, and further comprising:

means for protecting a portion of said oversurface distance from contaminants within said housing, said means including an annular gap defined between each said pin and said inner passage wall of a corresponding said through passage, said annular gap extending axially along said pin and having an open gap end and a closed gap end, and said inner passage wall and corresponding said pin being closely spaced from one another at an axial location toward said open gap end, whereby said annular gap inhibits the deposit of contaminants on said protected portion of said oversurface distance.

* * * * *